US006502726B1

(12) United States Patent
Yquel

(10) Patent No.: US 6,502,726 B1
(45) Date of Patent: Jan. 7, 2003

(54) PACKAGING AND DISPENSING DEVICE FITTED WITH A DISPENSER HEAD

(75) Inventor: Jean-Pierre Yquel, Colombes (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/615,409

(22) Filed: Jul. 13, 2000

(30) Foreign Application Priority Data

Jul. 22, 1999 (FR) ..... 99 09531
Jul. 30, 1999 (FR) ..... 99 09934

(51) Int. Cl.[7] ..... B65D 83/00
(52) U.S. Cl. ..... 222/321.1; 222/383.1; 222/402.1
(58) Field of Search ..... 222/321.1, 383.1, 222/402.1

(56) References Cited

U.S. PATENT DOCUMENTS 4,511,069 A * 4/1985 Kalat ..... 222/321
4,814,018 A * 3/1989 Tsurumaru et al. ..... 106/457
5,001,932 A 3/1991 Light et al. ..... 73/644
5,483,028 A * 1/1996 Holwerda ..... 181/207
5,522,383 A 6/1996 Calvert et al. ..... 128/203.15
5,527,577 A * 6/1996 Walter et al. ..... 222/402.1
5,597,095 A 1/1997 Ferrara, Jr. ..... 222/402.12
5,683,706 A * 11/1997 LaFleur et al. ..... 424/401
5,730,332 A * 3/1998 Zimmerhackel ..... 222/402.1

FOREIGN PATENT DOCUMENTS

JP PCT/JP95/00986 * 11/1995 ..... A01N/25/10

* cited by examiner

*Primary Examiner*—J. Casimer Jacyna
(74) *Attorney, Agent, or Firm*—Oliff & Berridge, PLC

(57) ABSTRACT

The invention relates to a packaging and dispensing device fitted with a dispenser head. The dispenser head is made at least in part out of a filled plastics material containing a filler whose density is not less than that of the plastics material, the nature and/or the content of the filler being selected in such a manner as to diminish and/or modify the operating noise of the dispenser head.

36 Claims, 1 Drawing Sheet

PACKAGING AND DISPENSING DEVICE FITTED WITH A DISPENSER HEAD

BACKGROUND OF THE INVENTION

Dispenser heads presently in use for dispensing a substance, e.g. generating aerosol sprays for cosmetic purposes in particular, are usually made out of a plastics material such as polypropylene and generally comprise a fixed body secured to the receptacle, the receptacle being fitted with a valve and with a movable pushbutton for actuating the control rod of the valve.

When the user presses down the pushbutton, the substance contained in the receptacle is dispensed via one or more nozzles secured to the pushbutton, generally in the form of a cloud of fine droplets.

Very many improvements have been made to dispenser heads in order to simplify manufacture and/or improve the properties of the aerosol spray delivered.

Nevertheless, so far as the Applicant company is aware, no such improvement relates to the noise made by the dispenser head in operation.

OBJECTS AND SUMMARY OF THE INVENTION

An object of the present invention is to make the operating noise of the dispenser head more agreeable for the user.

The invention achieves this by the dispenser head being made at least in part out of a filled plastics material containing a filler whose density is not less than that of the plastics materials, the nature and/or the content of the filler being selected in such a manner as to diminish and/or modify the operating noise of the dispenser head. In a particular embodiment, the filled plastics material contains more than 50% by weight of a filler relative to the total weight of the filled plastics material.

Although proposals have been made in other technical fields, such as the automobile industry, to use filled plastics materials for the purpose of improving the vibrational properties of certain components, the use of a filled plastics material for the purpose of modifying the operating noise of a dispenser head while dispensing a substance, e.g. the noise caused by generating an aerosol spray, has not yet been proposed.

By means of the invention, the operating noise of the dispenser head is attenuated and/or the main peaks in its acoustic spectrum (frequencies that can be heard by humans) is shifted towards frequencies that are more agreeable to the ear.

Preferably, the filler used has density that is at least twice that of the plastics material with which it is mixed, and preferably its density is at least three times that of the plastics material used.

The filler can advantageously be selected from inorganic substances of density greater than or equal to 3 g/cm$^3$, such as, for example, metal oxides, sulfides, hydroxides, sulfates, or phosphates, or a mixture thereof.

As a filler that is used in preferred manner, mention can be made for example of magnetite, hematite, and barium sulfate.

Advantageously, the plastics material used is polypropylene and the filler is constituted by magnetite constituting at least 60% relative to the total weight of the filled plastics material.

Preferably, the filler used is electrically conductive so as to reduce the risks of accumulating static electricity.

The invention also provides a pressurized receptacle fitted with a dispenser head as specified above.

BRIEF DESCRIPTION OF THE DRAWING

The invention will be better understood on reading the following detailed description of a non-limiting embodiment of the invention and on examining the accompanying drawing in which the sole

MORE DETAILED DESCRIPTION

Figure 1:
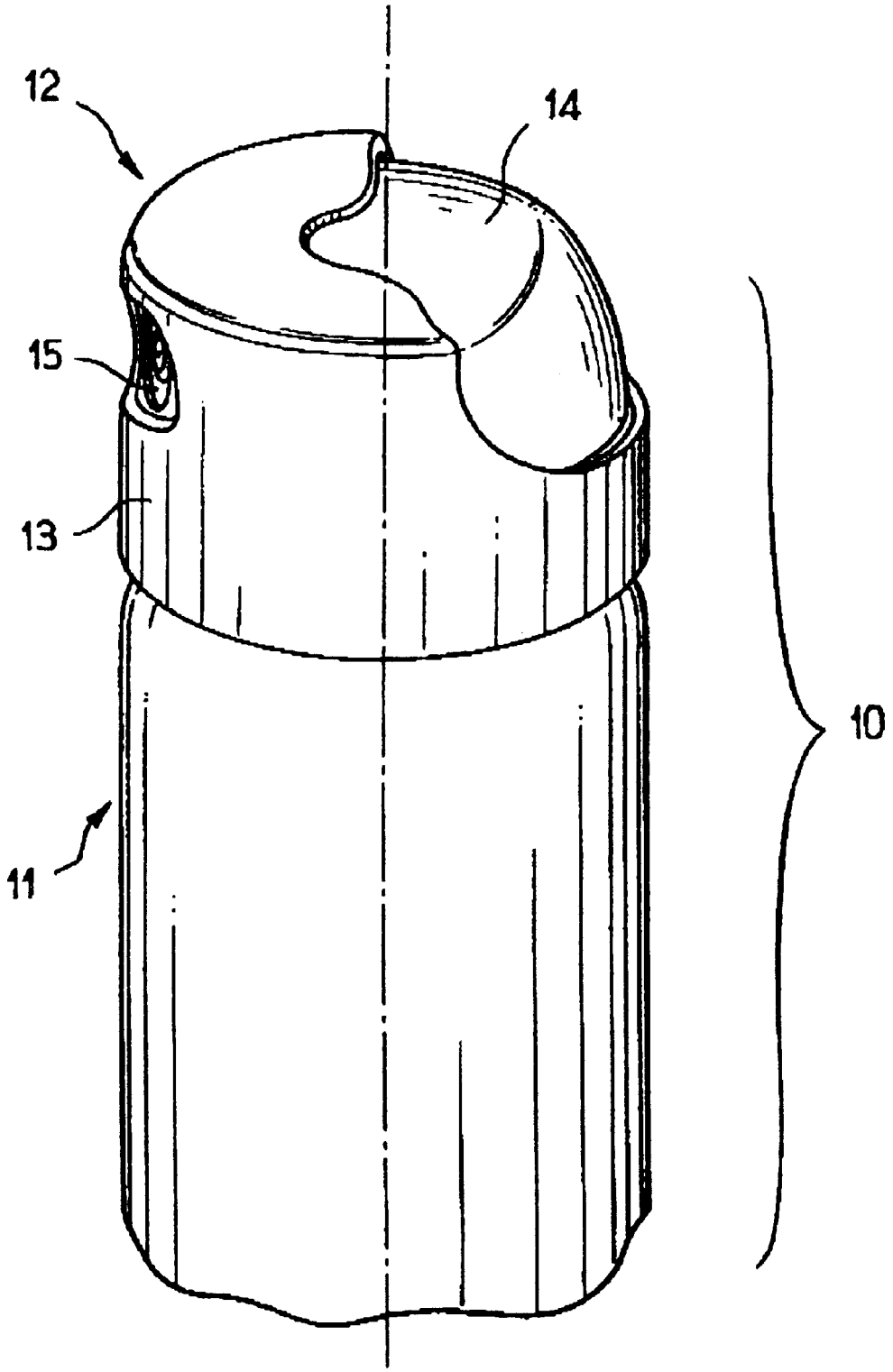
FIG. 1 shows a pressurized receptacle fitted with a dispenser head of the invention.

The packaging device 10 shown in FIG. 1 is of the aerosol can type and comprises a pressurized receptacle 11 fitted with a dispenser head 12 which itself comprise a body 13 fixed on the receptacle 11 and a pushbutton 14 that is movable relative to the body 13.

The pushbutton 14 serves to actuate the control rod of the valve of the receptacle 11 (not shown in FIG. 1).

The dispenser head 12 has a conventional spray nozzle 15 with a single orifice or with swirling channels, serving to dispense the substance contained in the receptacle 11 in the form of a cloud of fine droplets when the user presses on the pushbutton 14.

The dispenser head 12 has the special feature of being made at least in part out of a filled plastics material containing at least 50% of a filler for attenuating operating noise and/or for displacing the main peaks of its acoustic spectrum towards frequencies that are more agreeable to the ear.

In the example described, the body 13 of the dispenser head 12, the pushbutton 14, and the nozzle 15 are all made out of a mixture containing 64% by weight of magnetite and 36% by weight of polypropylene.

Plastics materials other than polypropylene could naturally be used, for example polyacetal or PET, and this list is not limiting.

The use of magnetite presents additional advantages over and above the fact of making the operating noise of the dispenser head more agreeable.

Magnetite makes it possible to add a colored filler to the polypropylene, such as carbon black.

It also confers a surface appearance that is mat, which is preferable from the esthetic point of view.

Finally, magnetite has properties of conducting electricity that make it possible to reduce the risk of accumulating electric charge and to enhance the draining of any such charge.

Naturally, the invention is not limited to the embodiment described above.

In particular, the shape of the dispenser head can be changed and it is possible to use a filler other than magnetite.

The dispenser head can be associated with a pump that is arranged to extract and dispense a substance contained in a receptacle that is not pressurized.

What is claimed is:

1. A packaging and dispensing device comprising a receptacle fitted with a dispenser head comprising a pushbutton, wherein at least one of a body of the dispenser head and the pushbutton is made out of a plastics material and a filler incorporated into the plastics material, said filler having a density higher than that of the plastics material, the nature and/or the content of the filler being selected in such a manner as to diminish and/or modify the operating noise of the dispenser head.

2. A device according to claim 1, wherein the filled plastics material has more than 50% by weight of filler, relative to the total weight of the filled plastics material.

3. A device according to claim 1, wherein the filler is an inorganic filler.

4. A device according to claim 1, wherein the plastics material used is polypropylene.

5. A device according to claim 1, wherein the filler comprises not less than 60% by weight relative to the total weight of the mixture.

6. A device according to claim 5, wherein the filler is magnetite and the plastics material is polypropylene, the filler comprising about 64% by weight.

7. A device according to claim 1, wherein the filler used is sufficiently electrically conductive to reduce the risks of accumulating static electricity.

8. A device according to claim 1, wherein said receptacle is pressurized.

9. A device according to claim 1, wherein the dispenser head is associated with a pump enabling substance to be extracted from said receptacle that is not pressurized.

10. A device according to claim 1, wherein the density of the filler used is at least three times that of the plastics material with which it is mixed.

11. A device according to claim 1, wherein the filler is selected from the group consisting of oxides, sulfides, hydroxides, sulfates, and phosphates.

12. A device according to claim 1, wherein the filler is magnetic.

13. A device according to claim 1, wherein the dispenser head comprises the body containing said filler.

14. A device according to claim 1, wherein said pushbutton contains said filler.

15. A device according to claim 1, wherein said pushbutton and said body both contain said filler.

16. A packaging and dispensing device comprising a receptacle fitted with a dispenser head comprising a pushbutton, wherein the dispenser head comprises at least one part external to said receptacle, made out of a plastics material and a filler incorporated into said plastics material, said filler having a density which is at least twice that of the plastics material with which it is mixed and wherein the filler represents more than 50% by weight of total weight of the plastics material and filler.

17. A packaging and dispensing device comprising a pressurized receptacle fitted with a dispenser head comprising a pushbutton, wherein the dispenser head comprises at least one part external to said receptacle, made out of a plastics material and filler incorporated into said plastics material, said filler having a density that is higher than that of the plastics material, wherein the filler used is sufficiently electrically conductive to reduce the risks of accumulating static electricity.

18. A packaging and dispensing device comprising a receptacle fitted with a dispenser head comprising a pushbutton, wherein at least one of a body of the dispenser head and the pushbutton is made out of a plastics material and a filler incorporated into the plastics material, said filler having a density which is at least twice that of the plastics material, the nature and/or the content of the filler being selected in such a manner as to diminish and/or modify the operating noise of the dispenser head.

19. A device according to claim 18, wherein the filled plastics material has more than 50% by weight of filler, relative to the total weight of the filled plastics material.

20. A device according to claim 18 wherein the filler is an inorganic filler.

21. A device according to claim 18, wherein the plastics material used is polypropylene.

22. A device according to claim 18 wherein the filler used is magnetite, hematite, or barium sulfate.

23. A device according to claim 18, wherein the filler comprises not less than 60% by weight relative to the total weight of the mixture.

24. A device according to claim 23, wherein the filler is magnetite and the plastics material is polypropylene, the filler comprising about 64% by weight.

25. A device according to claim 18, wherein the filler used is sufficiently electrically conductive to reduce the risks of accumulating static electricity.

26. A device according to claim 18, wherein said receptacle is pressurized.

27. A device according to claim 18, wherein the dispenser head is associated with a pump enabling substance to be extracted from said receptacle that is not pressurized.

28. A device according to claim 18, wherein the density of the filler used is at least three times that of the plastics material with which it is mixed.

29. A device according to claim 18, wherein the filler is selected from the group consisting of oxides, sulfides, hydroxides, sulfates, and phosphates.

30. A device according to claim 18, wherein the filler is magnetic.

31. A device according to claim 18, wherein the dispenser head comprises the body external to said receptacle containing said filler.

32. A device according to claim 18, wherein said pushbutton contains said filler.

33. A device according to claim 18, wherein said pushbutton and said body both contain said filler.

34. A packaging and dispensing device comprising a receptacle fitted with a dispenser head comprising a pushbutton, wherein at least one of a body of the dispenser head and the pushbutton is made out of a plastics material and a filler incorporated into the plastics material, said filler having a density higher than that of the plastics material, the nature and/or the content of the filler being selected in such a manner as to diminish and/or modify the operating noise of the dispenser head, wherein the filler comprises at least one material selected from the group consisting of magnetite, hematite and barium sulfate.

35. A device according to claim 34 wherein the filler comprises not less than 60% by weight relative to the total weight of the mixture.

36. A device according to claim 35 wherein the filler is magnetite and the plastics material is polypropylene, the filler comprising about 64% by weight.

* * * * *